US012454812B2

(12) United States Patent
Okajima

(10) Patent No.: US 12,454,812 B2
(45) Date of Patent: Oct. 28, 2025

(54) WORK MACHINE AND METHOD FOR CONTROLLING WORK MACHINE

(71) Applicant: KOMATSU LTD., Tokyo (JP)

(72) Inventor: Kazumichi Okajima, Tokyo (JP)

(73) Assignee: KOMATSU LTD., Tokyo (JP)

( * ) Notice: Subject to any disclaimer, the term of this patent is extended or adjusted under 35 U.S.C. 154(b) by 4 days.

(21) Appl. No.: 18/578,414

(22) PCT Filed: Jun. 15, 2022

(86) PCT No.: PCT/JP2022/023974
§ 371 (c)(1),
(2) Date: Jan. 11, 2024

(87) PCT Pub. No.: WO2023/002782
PCT Pub. Date: Jan. 26, 2023

(65) Prior Publication Data

US 2024/0384508 A1 Nov. 21, 2024

(30) Foreign Application Priority Data

Jul. 21, 2021 (JP) ..... 2021-120722

(51) Int. Cl.
*E02F 9/20* (2006.01)
*E02F 9/08* (2006.01)
*F01P 3/18* (2006.01)

(52) U.S. Cl.
CPC ..... *E02F 9/2095* (2013.01); *E02F 9/0866* (2013.01)

(58) Field of Classification Search
CPC ..... E02F 9/2095; E02F 9/0866; E02F 9/226; F01P 2003/185; B60Y 2200/412
USPC ..... 307/9.1
See application file for complete search history.

(56) References Cited

U.S. PATENT DOCUMENTS

2019/0152297 A1* 5/2019 Chopko ..... B60H 1/00764
2021/0222399 A1 7/2021 Nomura et al.
2022/0290605 A1* 9/2022 Hara ..... F01P 5/02

FOREIGN PATENT DOCUMENTS

JP 2001-165105 A 6/2001
JP 2004-288516 A 10/2004
JP 2006-056313 A 3/2006
JP 2011-168232 A 9/2011
JP 2017-198135 A 11/2017
JP 2021-050666 A 4/2021
JP 2021-050667 A 4/2021
(Continued)

*Primary Examiner* — Rexford N Barnie
*Assistant Examiner* — Swarna N Chowdhuri
(74) *Attorney, Agent, or Firm* — Faegre Drinker Biddle & Reath LLP

(57) ABSTRACT

Provided is a work machine capable of realizing control for securing cooling capacity of a cooling fan. The work machine includes a power feeding device, a plurality of electric devices driven by power supply from the power feeding device, a sensor that detects consumption current of the electric devices, a cooling fan that is driven by power supply from the power feeding device and generates a flow of air, and a controller that controls the cooling fan. The electric device includes a first device provided with the sensor. The controller determines whether a sum of a consumption current of the electric device including a consumption current of the first device detected by the sensor and a consumption current of the cooling fan exceeds an output current of the power feeding device.

6 Claims, 4 Drawing Sheets

(56) References Cited

FOREIGN PATENT DOCUMENTS

| | | | |
|---|---|---|---|
| JP | 2021-063339 | A | 4/2021 |
| WO | 2020/065996 | A1 | 4/2020 |
| WO | WO-2021/069101 | A1 | 4/2021 |

* cited by examiner

WORK MACHINE AND METHOD FOR CONTROLLING WORK MACHINE

TECHNICAL FIELD

The present disclosure relates to a work machine and a method for controlling the work machine.

BACKGROUND ART

Japanese Patent Laying-Open No. 2021-50666 (PTL 1) describes a cooling fan control device that controls a plurality of cooling fans. The cooling fan control device includes a controller. The controller optimizes a target rotation speed of each cooling fan within a range in which power consumption of the cooling fans does not exceed power capacity of a power supply source based on the power capacity of the power supply source and a sum of necessary power corresponding to a cooling state of an object to be cooled for each of the plurality of cooling fans.

CITATION LIST

Patent Literature

PTL 1: Japanese Patent Laying-Open No. 2021-50666

SUMMARY OF INVENTION

Technical Problem

Even when the cooling fan and an electric device are driven by electric power generated by a generator, it is necessary to secure cooling capacity of the object to be cooled by the cooling fan.

The present disclosure proposes a work machine and a method for controlling the work machine capable of realizing control for securing the cooling capacity of a cooling fan.

Solution to Problem

According to one aspect of the present disclosure, there is proposed a work machine including a power feeding device, a plurality of electric devices driven by power supply from the power feeding device, a sensor that detects a consumption current of the electric devices, a cooling fan driven by power supply from the power feeding device to generate a flow of air, and a controller that controls the cooling fan. The electric device includes a first device provided with the sensor that detects consumption current of the electric device. The controller determines whether a sum of the consumption current of the electric device including the consumption current of the first device detected by the sensor and the consumption current of the cooling fan exceeds an output current of the power feeding device.

Advantageous Effects of Invention

According to the work machine and the control method of the present disclosure, it is possible to realize control for securing the cooling capacity of the cooling fan.

DESCRIPTION OF EMBODIMENTS

Figure 1:
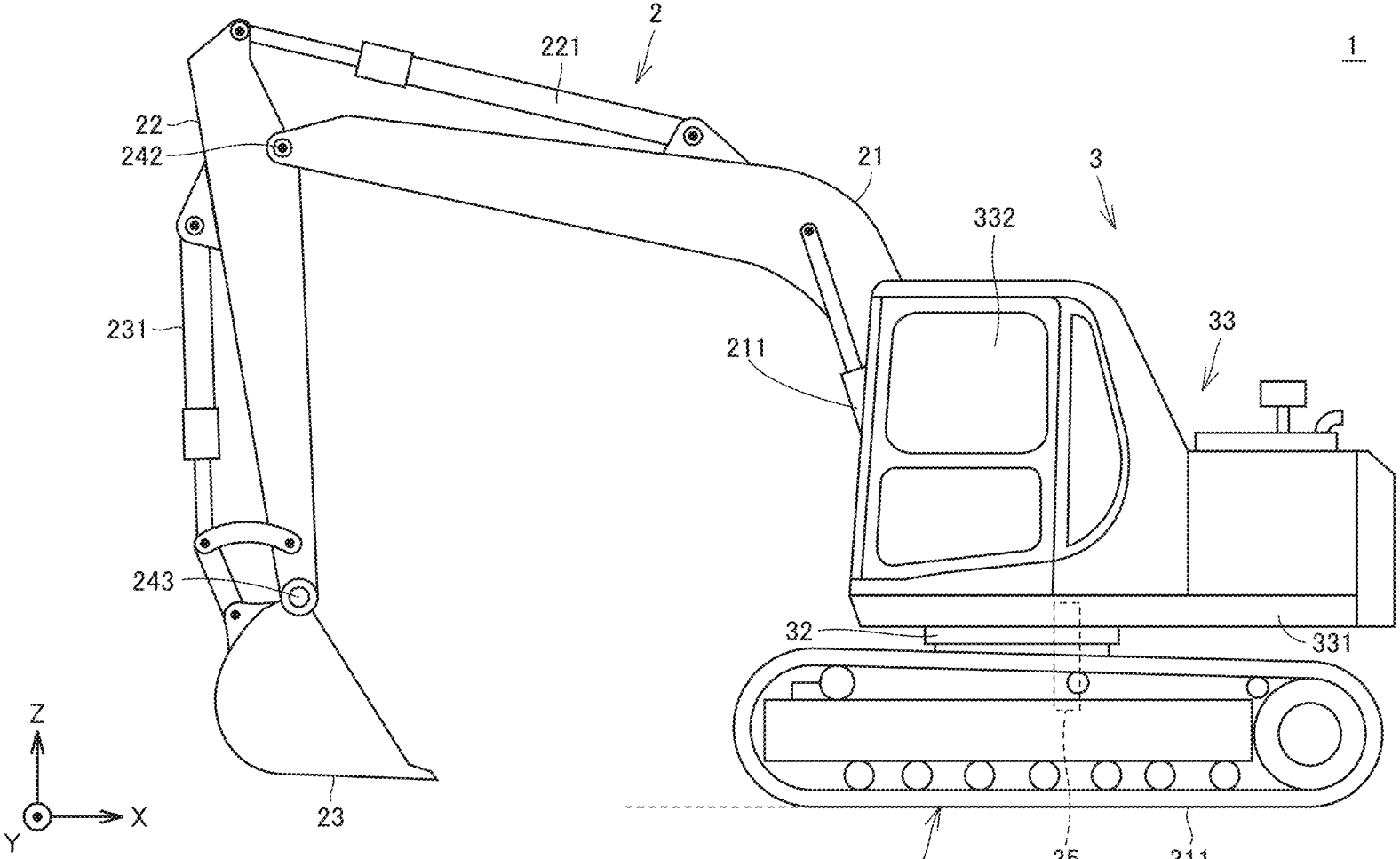
FIG. 1 is a side view schematically illustrating a configuration of a hydraulic excavator.

With reference to the drawings, hereinafter, embodiments will be described in detail. Note that, in the description and the drawings, the same components or corresponding components are denoted by the same reference numerals, and redundant description will not be repeated. Further, in the drawings, the configuration may be omitted or simplified for convenience of description.

<Overall Configuration>

In the embodiment, a hydraulic excavator 1 will be described as an example of a work machine. FIG. 1 is a side view schematically illustrating a configuration of hydraulic excavator 1.

As illustrated in FIG. 1, hydraulic excavator 1 includes a work implement 2 and a body 3. Body 3 includes a traveling portion 31, a swing circle 32, a revolving unit 33, and a hydraulic motor 35.

Traveling portion 31 includes a pair of left and right crawler belt apparatuses 311. Each of the pair of left and right crawler belt apparatuses 311 includes a crawler belt. When the pair of left and right crawler belts is rotationally driven, hydraulic excavator 1 self-propels.

Swing circle 32 is connected to hydraulic motor 35. Swing circle 32 is rotated by rotational driving of hydraulic motor 35. Hydraulic motor 35 is driven by hydraulic oil supplied from a hydraulic pressure source (a hydraulic pump and an oil tank that are not illustrated).

Revolving unit 33 is installed on traveling portion 31 with swing circle 32 interposed therebetween. Revolving unit 33 turns with respect to traveling portion 31 as swing circle 32 rotates.

Revolving unit 33 includes a frame 331 to which work implement 2 is attached, an operator's cab 332, and a controller 80 (see FIG. 2) that controls operations of hydraulic excavator 1. For example, operator's cab 332 is disposed on a front left side (a vehicle front side) of revolving unit 33.

Work implement 2 is supported by frame 331 on a front side of revolving unit 33, for example, on a right side of operator's cab 332. Work implement 2 includes a boom 21, a dipper stick 22, a bucket 23, a boom cylinder 211, a dipper stick cylinder 221, a bucket cylinder 231, and the like.

Boom 21 is attached to revolving unit 33. A proximal end of boom 21 is rotatably connected to revolving unit 33 by a boom foot pin (not illustrated).

Dipper stick 22 is attached to a distal end of boom 21. A proximal end of dipper stick 22 is rotatably connected to the distal end of boom 21 by a boom distal end pin 242.

Bucket 23 is attached to a distal end of dipper stick 22. Bucket 23 is rotatably connected to the distal end of dipper stick 22 by a dipper stick distal end pin 243. Bucket 23 is an example of an attachment that can be attached to a distal end of work implement 2.

Boom 21 can be driven by boom cylinder 211. Boom cylinder 211 is driven by hydraulic oil supplied from the hydraulic pressure source. With this driving, boom 21 is vertically turnable about the boom foot pin (not illustrated) with respect to revolving unit 33.

Dipper stick 22 can be driven by dipper stick cylinder 221. Dipper stick cylinder 221 is driven by hydraulic oil supplied from the hydraulic pressure source. By this driving, dipper stick 22 is vertically turnable with respect to boom 21 about boom distal end pin 242.

Bucket 23 can be driven by bucket cylinder 231. Bucket cylinder 231 is driven by hydraulic oil supplied from the hydraulic pressure source. By this driving, bucket 23 is vertically turnable with respect to dipper stick 22 about dipper stick distal end pin 243. In this way, work implement 2 can be driven.

<System Configuration>

Figure 2:
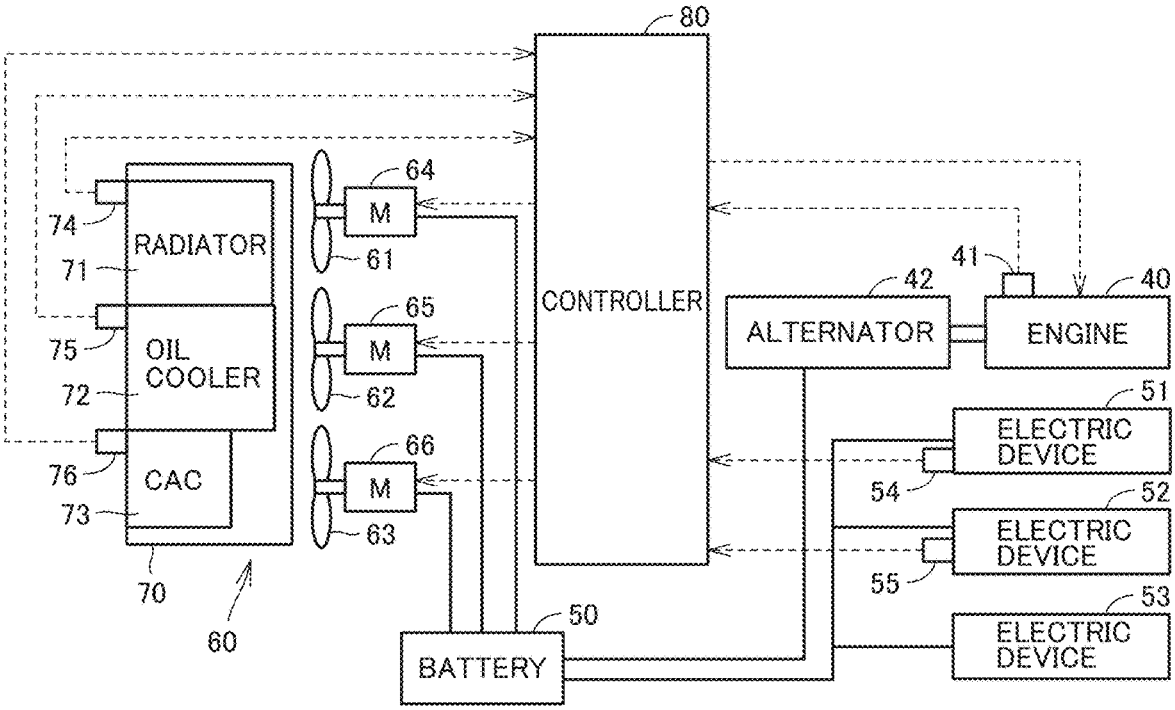
FIG. 2 is a schematic block diagram illustrating a system configuration of the hydraulic excavator.

FIG. 2 is a schematic block diagram illustrating a system configuration of hydraulic excavator 1. An engine 40 is a drive source for the operation of hydraulic excavator 1. Engine 40 is an internal combustion engine, for example, a diesel engine. A rotation speed of engine 40 is controlled by adjusting an amount of fuel injected into a cylinder. This adjustment is performed by controller 80 controlling a governor attached to a fuel injection pump of engine 40. The rotation speed of engine 40 is detected by a rotation speed sensor 41. A detection signal indicating the rotation speed of engine 40 detected by rotation speed sensor 41 is input from rotation speed sensor 41 to controller 80.

An output shaft of engine 40 is connected to an alternator 42. Alternator 42 operates as a generator that generates power by a driving force generated by engine 40. Alternator 42 corresponds to a power feeding device of the embodiment. A rotation speed of alternator 42 is set according to the rotation speed of engine 40. As the rotation speed of engine 40 increases, the rotation speed of alternator 42 increases, and power generation amount of alternator 42 also increases.

Alternator 42 and a battery 50 are electrically connected. Electric power generated by alternator 42 is stored in battery 50. Battery 50 is a power storage device that stores electric power. Battery 50 is a secondary battery such as a nickel hydrogen battery or a lithium hydrogen battery.

Battery 50 is electrically connected to a plurality of electric devices 51 to 53. The electric power generated by alternator 42 is supplied to electric devices 51 to 53 via battery 50. Each of electric devices 51 to 53 is driven by power supplied from alternator 42.

A current sensor 54 detects consumption current of electric device 51. A current sensor 55 detects consumption current of electric device 52. Electric device 53 is not provided with a current sensor that detects consumption current of electric device 53. Electric devices 51 and 52 correspond to the first device of the embodiment in which a sensor that detects consumption current of electric devices 51 and 52 is provided. Electric device 53 corresponds to the second device of the embodiment in which the sensor that detects the consumption current of electric device 53 is not provided. For example, electric device 51 may be a light, electric device 52 may be an air conditioner, and electric device 53 may be a wiper. An electric device having a relatively large consumption current may be the first device provided with a current sensor, and an electric device having a relatively small consumption current may be the second device not provided with a current sensor.

A detection signal indicating the consumption current of electric device 51 detected by current sensor 54 is input from current sensor 54 to controller 80. A detection signal indicating the consumption current of electric device 52 detected by current sensor 55 is input from current sensor 55 to controller 80. Controller 80 is configured to be able to grasp the consumption current of electric devices 51 and 52 upon receiving the input of the detection signal from current sensors 54 and 55, and to be unable to grasp the consumption current of electric device 53 in which the current sensor is not provided.

A cooling device 60 of the embodiment includes a heat exchanger 70. Heat exchanger 70 of the embodiment includes a radiator 71, an oil cooler 72, and a charge air cooler (CAC) 73. Cooling water for engine 40 flows inside radiator 71. The hydraulic oil supplied to hydraulic actuators such as hydraulic motor 35, boom cylinder 211, dipper stick cylinder 221, and bucket cylinder 231 illustrated in FIG. 1 flows inside oil cooler 72. Air supplied to engine 40 flows inside CAC 73.

The cooling water of engine 40 is a fluid object to be cooled of radiator 71. The hydraulic oil is a fluid object to be cooled of oil cooler 72. Intake air of engine 40 is a fluid object to be cooled of CAC 73. A temperature sensor 74 detects the temperature of the cooling water passing through radiator 71. A temperature sensor 75 detects the temperature of the hydraulic oil passing through oil cooler 72. A temperature sensor 76 detects the temperature of the air passing through CAC 73. A detection signal indicating the temperature of the fluid object to be cooled detected by temperature sensors 74 to 76 is input from temperature sensors 74 to 76 to controller 80.

Cooling device 60 includes a plurality of cooling fans 61 to 63. Each of cooling fans 61 to 63 is disposed to face heat exchanger 70. Specifically, cooling fan 61 is disposed to face radiator 71, and allows air to flow to radiator 71. The flow of air generated by cooling fan 61 cools radiator 71. Cooling fan 61 is a fan for cooling the cooling water of engine 40 flowing through radiator 71.

Engine 40 corresponds to a heating source of the embodiment that generates heat and is cooled by cooling fan 61. Engine 40 transfers the generated heat to the cooling water. Heat transfer from engine 40 increases the temperature of the cooling water. When the cooling water whose temperature has increased passes through radiator 71, heat is dissipated to the flow of air generated by cooling fan 61, so that the cooling water is cooled and the temperature of the cooling water decreases. The cooling water whose temperature has decreased returns to engine 40, whereby engine 40 is cooled.

A cooling fan 62 is disposed to face oil cooler 72, and allows air to flow to oil cooler 72. The flow of air generated by cooling fan 62 cools oil cooler 72. Cooling fan 62 is a fan for cooling the hydraulic oil flowing through oil cooler 72. Cooling fan 63 is disposed to face CAC 73 and allows air to flow to CAC 73. The flow of air generated by cooling fan 63 cools CAC 73. Cooling fan 63 is a fan for cooling air flowing through CAC 73.

Cooling fans 61 to 63 are electric fans. Electric motors 64 to 66 are electrically connected to battery 50. Cooling fan 61 is driven by electric motor 64. Electric motor 64 is supplied with power from battery 50 and is driven in response to a control signal from controller 80. Cooling fan 62 is driven by electric motor 65. Electric motor 65 is supplied with power from battery 50 and is driven in response to the control signal from controller 80. Cooling fan 63 is driven by electric motor 66. Electric motor 66 is supplied with power from battery 50 and is driven in response to the control signal from controller 80.

The electric power generated by alternator 42 is supplied to electric motors 64 to 66 via battery 50. Cooling fans 61 to 63 are driven by power supplied from alternator 42 to generate a flow of air passing through heat exchanger 70. Cooling fans 61 to 63 are controlled by controller 80. Controller 80 performs, for example, pulse width modulation (PWM) control on electric motors 64 to 66. Controller 80 controls the rotation speed of each of cooling fans 61 to 63 by controlling the rotation speed of each of electric motors 64 to 66.

Controller 80 is a controller that controls the overall operation of hydraulic excavator 1, and includes a central processing unit (CPU), a nonvolatile memory, a timer, and the like. Controller 80 is electrically connected to engine 40, rotation speed sensor 41, current sensors 54 and 55, electric motors 64 to 66, temperature sensors 74 to 76, and the like.

A program for controlling cooling fans 61 to 63 is stored in advance in controller 80. Controller 80 stores in advance a table of a current value generated and output by alternator 42 with respect to the rotation speed of engine 40, a table of the rotation speed of cooling fans 61 to 63 with respect to the temperature of the fluid object to be cooled detected by temperature sensors 74 to 76, a table of the consumption current of cooling fans 61 to 63 with respect to the rotation speed of cooling fans 61 to 63, a table of a torque output by engine 40 with respect to the rotation speed of engine 40, and the like. Instead of the various tables described above, controller 80 may store a function. Controller 80 stores in advance a set value of the consumption current of electric device 53 provided with no current sensor.

Controller 80 is mounted on hydraulic excavator 1. Controller 80 may not be mounted on hydraulic excavator 1. Controller 80 may be disposed outside hydraulic excavator 1. Controller 80 may be disposed at a work site of hydraulic excavator 1 or may be disposed at a remote place away from the work site of hydraulic excavator 1. Hydraulic excavator 1 and controller 80 disposed outside hydraulic excavator 1 may constitute a control system of hydraulic excavator 1.

<Control of Cooling Fans 61 to 63>

Figure 3:
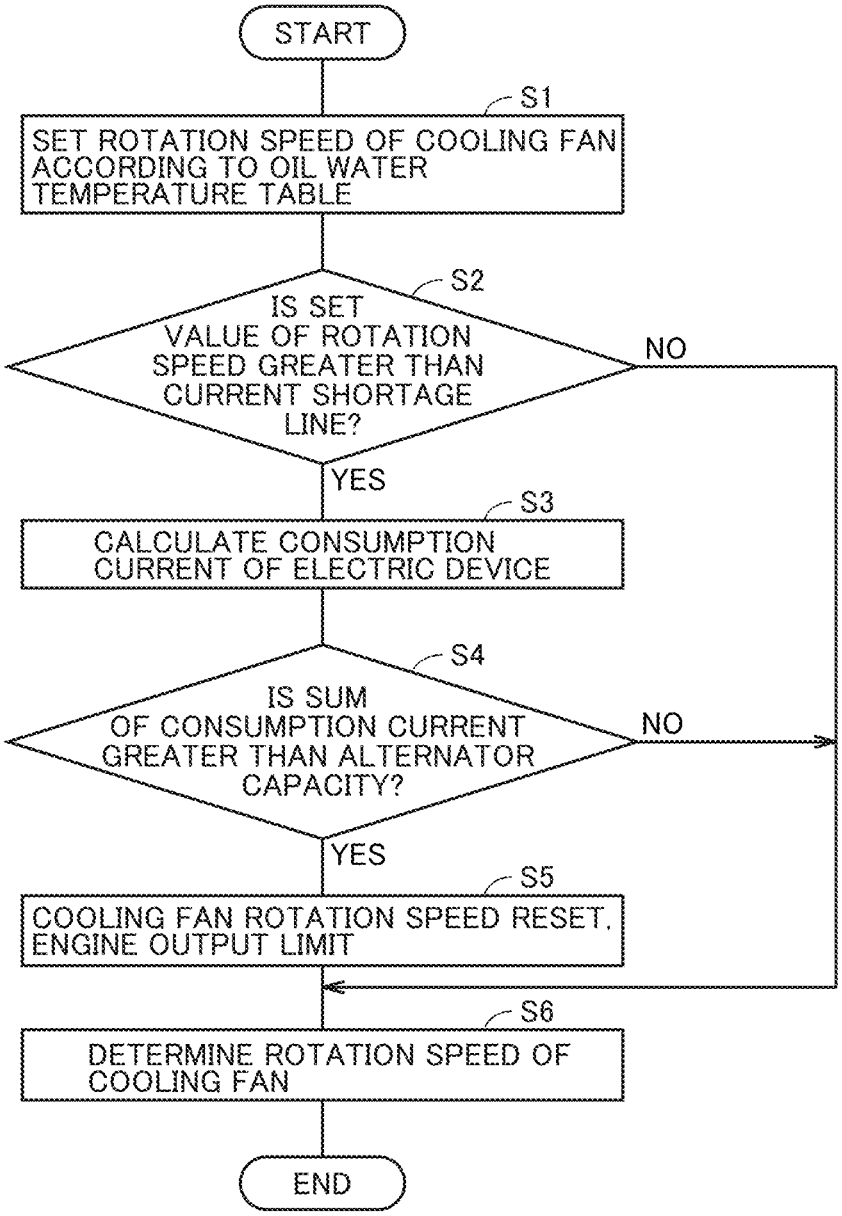
FIG. 3 is a flowchart illustrating an example of control of a cooling fan.

Control of cooling fans 61 to 63 by controller 80 in hydraulic excavator 1 of the embodiment having the above configuration will be described below. FIG. 3 is the flowchart illustrating the example of control of cooling fans 61 to 63.

Figure 4:
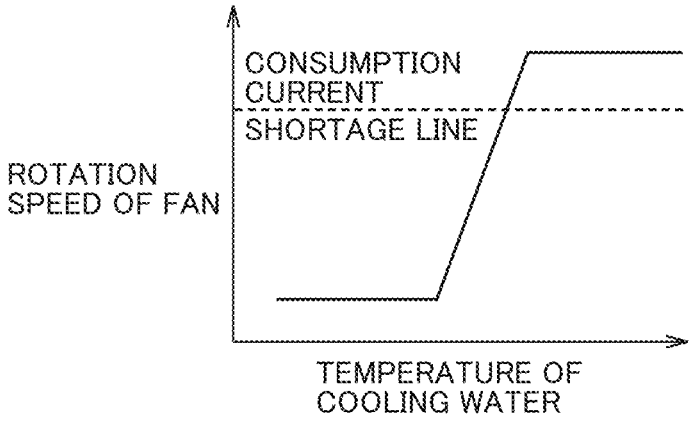
FIG. 4 is a diagram illustrating an example of a table of the rotation speed of the cooling fan with respect to a temperature of cooling water of an engine.

As illustrated in FIG. 3, in step S1, the rotation speed of cooling fans 61 to 63 is set according to an oil water temperature table. FIG. 4 is a diagram illustrating an example of a table of the rotation speed of cooling fan 61 with respect to the temperature of the cooling water of engine 40. A horizontal axis in FIG. 4 indicates the temperature of the cooling water of engine 40. The temperature of the cooling water of engine 40 is detected by temperature sensor 74. In FIG. 4, a vertical axis represents the rotation speed of cooling fan 61, that is, the rotation speed of electric motor 64. The table illustrated in FIG. 4 is stored in controller 80.

As illustrated in FIG. 4, when the temperature of the cooling water of engine 40 is less than or equal to a predetermined first temperature threshold, the rotation speed of cooling fan 61 is constant at a predetermined first rotation speed. When the temperature of the cooling water of engine 40 increases and exceeds the first temperature threshold, the rotation speed of cooling fan 61 increases. The rotation speed of cooling fan 61 increases linearly with respect to the temperature of the cooling water of engine 40 in a range where the temperature of the cooling water of engine 40 is greater than or equal to the first temperature threshold and less than or equal to a predetermined second temperature threshold. When the temperature of the cooling water of engine 40 is greater than or equal to the second temperature threshold, the rotation speed of cooling fan 61 is constant at a predetermined second rotation speed.

Controller 80 receives a detection signal of the temperature of the cooling water of engine 40 from temperature sensor 74. Controller 80 sets the rotation speed of cooling fan 61 necessary for cooling engine 40 corresponding to the temperature of the cooling water of engine 40, which is a detection value of temperature sensor 74, according to the table illustrated in FIG. 4.

Figure 5:
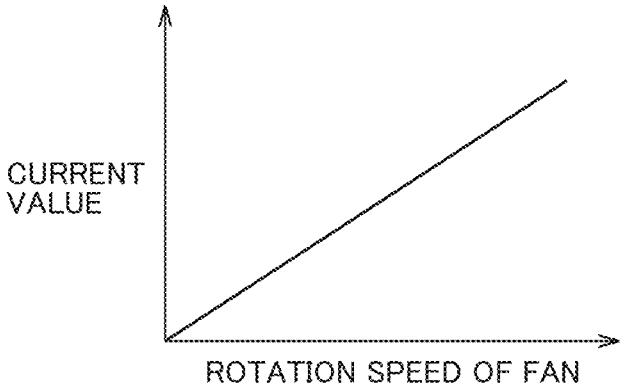
FIG. 5 is a diagram illustrating an example of a table of consumption current of the cooling fan with respect to the rotation speed of the cooling fan.

FIG. 5 is the diagram illustrating the example of the table of the consumption current of cooling fan 61 with respect to the rotation speed of cooling fan 61. In FIG. 5, the horizontal axis represents the rotation speed of cooling fan 61, and the vertical axis represents the consumption current of cooling fan 61. As illustrated in FIG. 5, the consumption current of cooling fan 61 may increase linearly with respect to the rotation speed of cooling fan 61. According to the table illustrated in FIG. 5, controller 80 obtains the consumption current of cooling fan 61 corresponding to the rotation speed of cooling fan 61 set by the table in FIG. 4.

A table similar to that in FIG. 4 is set for the temperature of the hydraulic oil and the rotation speed of cooling fan 62. A table similar to that in FIG. 5 is set for the rotation speed of cooling fan 62 and the consumption current of cooling fan 62. A table similar to FIG. 4 is set for the temperature of the intake air of engine 40 and the rotation speed of cooling fan 63. A table similar to that in FIG. 5 is set for the rotation speed of cooling fan 63 and the consumption current of cooling fan 63. Controller 80 sets the rotation speed of cooling fans 62 and 63 and obtains the consumption current of cooling fans 62 and 63.

Returning to FIG. 3, next in step S2, it is determined whether or not the set value of the rotation speed of cooling fans 61 to 63 exceeds a consumption current shortage line. As illustrated in FIG. 4, the consumption current shortage line corresponding to a predetermined rotation speed between the first rotation speed and the second rotation speed is set. In the present embodiment, a current value is obtained by subtracting the consumption current of the electric device other than electric motors 64 to 66 (for example, electric devices 51 to 53 illustrated in FIG. 2) from the current generated and output by alternator 42 in a case where all the consumption current of the electric device other than electric motors 64 to 66 is a maximum, the obtained current value is assigned to each cooling fans 61 to 63, and the consumption current shortage line indicates the rotation speed of each cooling fans 61 to 63 corresponding to the assigned current value.

As long as the rotation speed of cooling fan 61 is in a range less than or equal to the consumption current shortage line illustrated in FIG. 4 and the rotation speed of cooling fans 62 and 63 is also in the range less than or equal to the consumption current shortage line, the sum of the consumption current of the electric devices and the consumption current of cooling fans 61 to 63 does not exceed a generated current by alternator 42 even if all the electric devices other than electric motors 64 to 66 are used. On the other hand, if the rotation speed of any one or more of cooling fans 61 to 63 exceeds the consumption current shortage line, in a case where all the electric devices other than electric motors 64 to 66 are used, the sum of the consumption current of the electric devices other than electric motors 64 to 66 and the consumption current of cooling fans 61 to 63 may exceed the current generated and output by alternator 42.

Thereupon, when it is determined that the set value of the rotation speed of any of cooling fans 61 to 63 exceeds the consumption current shortage line (YES in step S2), the consumption current of the electric device other than electric motors 64 to 66 is calculated in step S3. Controller 80 receives a detection signal of the consumption current of electric device 51 from current sensor 54. Controller 80 receives a detection signal of the consumption current of electric device 52 from current sensor 55. Controller 80 calculates a sum of the consumption current of electric device 51 detected by current sensor 54, the consumption current of electric device 52 detected by current sensor 55, and the set value of the consumption current of electric device 53 stored in advance in controller 80 as the consumption current of the electric device other than electric motors 64 to 66.

Next, in step S4, it is determined whether or not the sum of the consumption current of the electric devices other than electric motors 64 to 66 calculated in step S3 and the consumption current of cooling fans 61 to 63 obtained in step S1 exceeds the generated current by alternator 42.

Controller 80 receives a detection signal of the rotation speed of engine 40 from rotation speed sensor 41. Controller 80 calculates the generated current of alternator 42 from the rotation speed of engine 40 detected by rotation speed sensor 41 according to a table of the generated current of alternator 42 with respect to the rotation speed of engine 40 stored in advance in controller 80. Controller 80 compares the calculated generated current of alternator 42 with the sum of the consumption currents of the electric device and cooling fans 61 to 63, and determines whether the consumption current of the electric device and cooling fans 61 to 63 exceeds the generated current of alternator 42.

When it is determined in step S4 that the sum of the consumption current of the electric device and the consumption current of cooling fans 61 to 63 exceeds the generated current of alternator 42 (YES in step S4), the process proceeds to step S5 to reset the rotation speed of cooling fans 61 to 63.

Controller 80 changes the setting of cooling fans 61 to 63. Specifically, controller 80 decreases the rotation speed of cooling fans 61 to 63. Typically, controller 80 sets each rotation speed of cooling fans 61 to 63 to a value less than or equal to the consumption current shortage line. As the rotation speed of cooling fans 61 to 63 decreases, the consumption current of cooling fans 61 to 63 decreases as illustrated in FIG. 5. Accordingly, controller 80 prevents the sum of the consumption current of the electric device and the consumption current of cooling fans 61 to 63 from exceeding the generated current of alternator 42.

Further, in step S5, output of engine 40 is also limited. By reducing the rotation speed of cooling fan 61, ability of cooling fan 61 to cool the cooling water of engine 40 is weakened. In order to prevent overheating of engine 40, controller 80 limits the output of engine 40. Controller 80 limits heat generation amount of engine 40 to suppress heat transfer from engine 40 to the cooling water. Controller 80 suppresses a temperature rise of the cooling water in engine 40 such that the cooling water of engine 40 is sufficiently cooled while passing through radiator 71 by cooling fan 61 of which the rotation speed is lowered and the cooling capacity is lowered.

Figure 6:
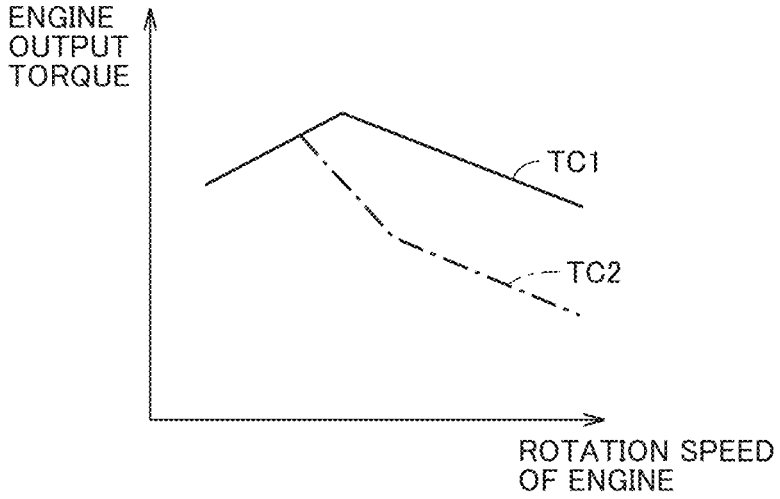
FIG. 6 is a diagram illustrating an example of an engine torque curve.

FIG. 6 is the diagram illustrating an example of the engine torque curve. The horizontal axis in FIG. 6 indicates the rotation speed of engine 40. In FIG. 6, the vertical axis represents an output torque of engine 40. An engine torque curve TC1 indicated by a solid line in FIG. 6 indicates an upper limit value of the torque that can be output by engine 40 in accordance with the rotation speed defined by the characteristics of engine 40. Engine torque curve TC1 defines a relationship between the rotation speed of engine 40 and the upper limit value of the output torque of engine 40. Normally, controller 80 controls the governor so as to control the output torque of engine 40 according to engine torque curve TC1.

A derated engine torque curve TC2 indicated by a one-dot chain line in FIG. 6 defines the upper limit value of the output torque lower than engine torque curve TC1. In a case where the output of engine 40 is limited, controller 80 controls the output of engine 40 according to derated engine torque curve TC2. Since the generated current of alternator 42 is set according to the rotation speed of engine 40, controller 80 performs control to cut off the output torque of engine 40 by a torque derating instead of decreasing the rotation speed of engine 40 when limiting the output of engine 40.

In step S6, controller 80 determines the rotation speed of cooling fans 61 to 63. When it is determined in step S2 that the set value of the rotation speed of cooling fans 61 to 63 is less than or equal to the consumption current shortage line (NO in step S2), the sum of the consumption current of the electric device and the consumption current of cooling fans 61 to 63 does not exceed the generated current of alternator 42 regardless of usage state of the electric device other than electric motors 64 to 66. Therefore, controller 80 determines the rotation speed set in step S1 as the rotation speed of cooling fans 61 to 63.

When it is determined in step S4 that the sum of the consumption current of the electric device and the consumption current of cooling fans 61 to 63 does not exceed the generated current of alternator 42 (NO in step S4), controller 80 determines the rotation speed set in step S1 as the rotation speed of cooling fans 61 to 63. Controller 80 can monitor the consumption current of electric devices 51 and 52 provided with current sensors 54 and 55 by the detection signal from current sensors 54 and 55. The usage state of the electric device is constantly monitored, and a surplus current not used in the electric device is used as the consumption current of cooling fans 61 to 63, so that cooling fans 61 to 63 can be operated at the rotation speed exceeding the consumption current shortage line.

In a case where the rotation speed of cooling fans 61 to 63 is reset in the process of step S5, controller 80 determines the reset rotation speed as the rotation speed of cooling fans 61 to 63. Controller 80 controls cooling fans 61 to 63 based on a determined rotation speed. Controller 80 outputs the control signal to electric motors 64 to 66 so that cooling fans 61 to 63 operate at the determined rotation speed. Then, the process ends (END).

<Function and Effect>

Although there is a description partially overlapping with the description above, characteristic configurations as well as functions and effects of the present embodiment will be collectively described as follows.

As illustrated in FIG. 2, the electric device driven by power supply from alternator 42 includes the first device provided with a sensor that detects the consumption current of the electric device. As illustrated in FIG. 3, controller 80 determines whether the sum of the consumption current of the electric device including the consumption current of the first device detected by the sensor and the consumption current of cooling fans 61 to 63 exceeds the output current of alternator 42.

The electric device is driven and cooling fans 61 to 63 are driven by the generated current of alternator 42. By monitoring the current used by the electric device, allowing cooling fans 61 to 63 to use excess current not used by the electric device, and increasing the current that can be used by cooling fans 61 to 63, cooling fans 61 to 63 can be operated at a higher rotation speed. Typically, cooling fans 61 to 63 can be rotated at a rotation speed greater than or equal to the consumption current shortage line illustrated in FIG. 4. It is possible to continue to operate cooling fans 61 to 63 at a maximum current, and it is possible to realize control for securing the cooling capacity of the fluid object to be cooled by cooling fans 61 to 63.

As illustrated in FIG. 3, when the sum of the consumption current of the electric device and the consumption current of cooling fans 61 to 63 exceeds the output current of alternator 42, controller 80 changes the setting of cooling fans 61 to 63 such that the sum of the consumption current of the electric device and the consumption current of cooling fans 61 to 63 does not exceed the output current of alternator 42. When insufficient current is supplied from battery 50 in a case where the generated current of alternator 42 is insufficient, battery 50 may be over-discharged, and storage function of battery 50 may be deteriorated. By changing the setting of cooling fans 61 to 63, more specifically, by limiting the rotation speed of cooling fans 61 to 63 to reduce the consumption current of cooling fans 61 to 63, it is possible to continue to operate both the electric device and cooling fans 61 to 63 by power supply from alternator 42.

As illustrated in FIG. 3, when the sum of the consumption current of the electric device and the consumption current of cooling fans 61 to 63 exceeds the output current of alternator 42, controller 80 limits the output of engine 40. When the rotation speed of cooling fans 61 to 63 is lowered, the cooling capacity of the fluid object to be cooled by cooling fans 61 to 63 is lowered. Insufficient cooling of the cooling water of engine 40 causes the overheating of engine 40. The overheating of engine 40 can be prevented by reducing the heat generation amount of engine 40 by limiting the output of engine 40 as the rotation speed of cooling fans 61 to 63 is reduced.

As illustrated in FIG. 3, in a case where the sum of the consumption current of the electric device and the consumption current of cooling fans 61 to 63 does not exceed the output current of alternator 42, controller 80 controls cooling fans 61 to 63 based on the rotation speed corresponding to the consumption current of cooling fans 61 to 63. By allowing cooling fans 61 to 63 to use the excess current that is not used by the electric device, cooling fans 61 to 63 can be rotated at a rotation speed greater than or equal to the rotation speed of the consumption current shortage line illustrated in FIG. 4, and control for securing the cooling capacity of the fluid object to be cooled by cooling fans 61 to 63 can be realized.

As illustrated in FIG. 2, the electric device driven by the power supply from alternator 42 includes the second device in which a sensor for detecting the consumption current of the electric device is not provided. As illustrated in FIG. 3, controller 80 calculates, as the consumption current of the electric device, the sum of the consumption current of the first device detected by the sensor and the set value of the consumption current of the second device stored in advance. In this way, controller 80 can calculate the consumption current of the electric device more accurately.

As illustrated in FIGS. 3 and 4, controller 80 sets the rotation speed of cooling fans 61 to 63 based on the temperature of the fluid object to be cooled obtained as the detection value of temperature sensors 74 to 76. As illustrated in FIG. 5, controller 80 obtains the consumption current of cooling fans 61 to 63 from the set rotation speed of cooling fans 61 to 63. Accordingly, controller 80 can accurately acquire the consumption current of cooling fans 61 to 63. Controller 80 can accurately determine whether the sum of the consumption current of the electric device and the consumption current of cooling fans 61 to 63 exceeds the output current of alternator 42 using the acquired consumption current of cooling fans 61 to 63.

In the embodiment above, the control of reducing the rotation speed of cooling fans 61 to 63 and limiting the output of engine 40 in a case where the generated current of alternator 42 is insufficient with respect to the consumption current of the electric device and cooling fans 61 to 63 has been described. Without being limited to this example, and an alarm may be configured to issue an alert when it is determined that the generated current of alternator 42 is insufficient with respect to the consumption current of the electric device and cooling fans 61 to 63. The alert may be audio, visual, tactile, or a combination thereof. The operator of hydraulic excavator 1 who has recognized the alert can decrease the consumption current of the electric device and increase the current that can be used by cooling fans 61 to 63, for example, by temporarily stopping an air conditioner in operator's cab 332. In this way, the operation can be continued without limiting the output of engine 40.

Cooling device 60 of the embodiment includes three heat exchangers 70, that is, radiator 71, oil cooler 72, and CAC 73. The number of heat exchangers may be less than or equal to two, or greater than or equal to four. Examples of the heat exchanger are not limited to the above three, and may be, for example, a condenser of an air conditioner, a fuel cooler, or the like.

In the embodiment, an example in which cooling device 60 includes three cooling fans 61 to 63 has been described. Cooling device 60 may have less than or equal to two electric cooling fans or greater than or equal to four electric cooling fans. The number of heat exchangers and the number of cooling fans may be different. Greater than or equal to two cooling fans may cool one heat exchanger. One cooling fan may cool heat exchangers that are greater than or equal to two. Heat exchangers that are greater than or equal to two and is cooled by one cooling fan may be arranged side by side along the flow of air generated by the cooling fan.

In the embodiment, the temperature sensor is provided for each heat exchanger, but there may be a heat exchanger without a temperature sensor. For example, one heat exchanger of greater than or equal to two heat exchangers cooled by one cooling fan may be provided with a temperature sensor that detects a temperature of the fluid object to be cooled of the heat exchanger, and the rotation speed of the cooling fan may be controlled based on the detection value of the temperature sensor, and in this case, the other heat exchanger of the greater than or equal to two heat exchangers may not be provided with the temperature sensor.

In the embodiment, hydraulic excavator 1 has been described as an example of the work machine. However, the idea of the present disclosure may be applied not only to hydraulic excavator 1 but also to other types of work machines such as a crawler dozer, a wheel loader, and a dump truck.

While the embodiments have been described above, it should be understood that the embodiments disclosed herein are illustrative in all respects and not restrictive. The scope of the present invention is indicated by the claims rather than the description above, and it is intended that all modifications within the meaning and scope equivalent to the terms of the claims are included in the scope of the present invention.

REFERENCE SIGNS LIST

1: hydraulic excavator, 2: work implement, 3: body, 21: boom, 22: dipper stick, 23: bucket, 31: traveling portion, 32: swing circle, 33: revolving unit, 35: hydraulic motor, 40: engine, 41: rotation speed sensor, 42: alternator, 50: battery, 51, 52, 53: electric device, 54, 55: current sensor, 60: cooling device, 61, 62, 63: cooling fan, 64, 65, 66: electric motor, 70: heat exchanger, 71: radiator, 72: oil cooler, 73: CAC, 74, 75, 76: temperature sensor, 80: controller, 211: boom cylinder, 221: dipper stick cylinder, 231: bucket cylinder, 242: boom distal end pin, 243: dipper stick distal end pin, 311: crawler belt apparatus, 331: frame, 332: operator's cab, TC1: engine torque curve, TC2: derated engine torque curve

The invention claimed is:

1. A work machine comprising:

a power feeding device;

a plurality of electric devices driven by power supply from the power feeding device;

a sensor that detects consumption current of the electric device;

a cooling fan that is driven by power supply from the power feeding device and generates a flow of air;

a heating source that generates heat and is cooled by the cooling fan; and a controller that controls the cooling fan, wherein the electric device includes a first device in which the sensor is provided, the controller determines whether a sum of a consumption current of the electric device, including a consumption current of the first device detected by the sensor and a consumption current of the cooling fan, exceeds an output current of the power feeding device, and the controller limits output of the heating source in a case where the sum of the consumption current of the electric device and the consumption current of the cooling fan exceeds the output current of the power feeding device as a result of the determination.

2. The work machine according to claim 1, wherein in a case where the sum of the consumption current of the electric device and the consumption current of the cooling fan exceeds the output current of the power feeding device as a result of the determination, the controller changes setting of the cooling fan so that the sum of the consumption current of the electric device and the consumption current of the cooling fan does not exceed the output current of the power feeding device, and controls the cooling fan based on a rotation speed corresponding to a changed consumption current.

3. The work machine according to claim 1, wherein in a case where the sum of the consumption current of the electric device and the consumption current of the cooling fan does not exceed the output current of the power feeding device as a result of the determination, the controller controls the cooling fan based on a rotation speed corresponding to the consumption currents.

4. The work machine according to claim 1, wherein the electric device includes a second device in which the sensor is not provided, and the controller calculates, as the consumption current of the electric device, the sum of the consumption current of the first device detected by the sensor and a set value of a consumption current of the second device stored in advance.

5. The work machine according to claim 1, further comprising:

a heat exchanger through which a fluid object to be cooled flows inside; and a temperature sensor that measures a temperature of the fluid object to be cooled, wherein the flow of air generated by the cooling fan cools the heat exchanger, and the controller sets a rotation speed of the cooling fan based on a detection value of the temperature sensor, and obtains the consumption current of the cooling fan from the set rotation speed.

6. A method for controlling a work machine, the work machine including:

a power feeding device;

a plurality of electric devices driven by power supply from the power feeding device;

a sensor that detects consumption current of the electric device;

a cooling fan that is driven by power supply from the power feeding device and generates a flow of air; and a heating source that generates heat and is cooled by the cooling fan, wherein the electric device includes a first device in which the sensor is provided, the method comprising:

detecting a consumption current of the first device by the sensor;

calculating a sum of a consumption current of the electric device including the consumption current of the first device detected by the sensor and a consumption current of the cooling fan;

determining whether the calculated sum of the consumption currents exceeds an output current of the power feeding device; and limiting output of the heating source in a case where the sum of the consumption current of the electric device and the consumption current of the cooling fan exceeds the output current of the power feeding device as a result of the determination.

* * * * *